US007677867B2

(12) United States Patent
Chekanov et al.

(10) Patent No.: US 7,677,867 B2
(45) Date of Patent: Mar. 16, 2010

(54) GUIDE VANE ARRANGEMENT OF A TURBOMACHINE

(75) Inventors: Alexander Chekanov, Moscow (RU); Alexander Khanin, Moscow (RU)

(73) Assignee: ALSTOM Technology Ltd, Baden (DE)

( * ) Notice: Subject to any disclaimer, the term of this patent is extended or adjusted under 35 U.S.C. 154(b) by 74 days.

(21) Appl. No.: 12/033,094

(22) Filed: Feb. 19, 2008

(65) Prior Publication Data

US 2008/0199312 A1 Aug. 21, 2008

Related U.S. Application Data

(63) Continuation of application No. PCT/EP2006/065188, filed on Aug. 9, 2006.

(30) Foreign Application Priority Data

Aug. 17, 2005 (CH) ..... 1348/05

(51) Int. Cl.
*F01D 9/00* (2006.01)

(52) U.S. Cl. ..... 415/209.3; 415/213.1

(58) Field of Classification Search ..... 415/209.3, 415/209.4, 210.1, 213.1, 139
See application file for complete search history.

(56) References Cited

U.S. PATENT DOCUMENTS

| | | | | |
|---|---|---|---|---|
| 2,910,269 | A | 10/1959 | Haworth et al. | |
| 2,982,519 | A | 5/1961 | Haworth et al. | |
| 3,471,126 | A | 10/1969 | Abild | |
| 5,022,818 | A * | 6/1991 | Scalzo | 415/209.3 |
| 5,131,814 | A * | 7/1992 | Przytulski et al. | 416/217 |
| 5,498,126 | A * | 3/1996 | Pighetti et al. | 415/115 |
| 7,094,025 | B2 * | 8/2006 | Arness et al. | 415/189 |
| 7,094,026 | B2 * | 8/2006 | Coign et al. | 415/189 |
| 7,258,525 | B2 * | 8/2007 | Boeck | 415/209.3 |
| 2004/0173975 | A1 | 9/2004 | Hirst | |

(Continued)

FOREIGN PATENT DOCUMENTS

| | | |
|---|---|---|
| EP | 0943785 | 9/1999 |

(Continued)

OTHER PUBLICATIONS

Republic of China (Taiwan) Search Report, search completed on Sep. 29, 2009, which issued during prosecution of Taiwan Patent Application No. 095130301.

*Primary Examiner*—Ninh H Nguyen
(74) *Attorney, Agent, or Firm*—Darby & Darby

(57) ABSTRACT

A guide vane arrangement of a turbomachine includes a casing, at least one guide vane carrier connected to the casing and having a first carrying portion and a second carrying portion spaced apart axially from the first carrying portion, a plurality of guide vanes connected to the guide vane carrier and arranged next to each other in a circumferential direction, and at least one securing element connected to the guide vane carrier and configured to provide an axial fixing of at least one of the guide vanes. Each guide vane has a platform including a first locking portion and a second locking portion spaced apart axially from the first locking portion, wherein each of the first and second locking portions and the respective first and second carrying portion are adapted to provide an axially pluggable and a radially positive fastening between the guide vane carrier and the respective guide vane.

19 Claims, 2 Drawing Sheets

U.S. PATENT DOCUMENTS

| | | | |
|---|---|---|---|
| 2005/0111969 | A1 | 5/2005 | Arness et al. |

FOREIGN PATENT DOCUMENTS

| | | | |
|---|---|---|---|
| EP | 1221539 | | 7/2002 |
| GB | 995643 | | 6/1965 |
| JP | 5872606 | A | 4/1983 |
| JP | 2000213301 | A | 8/2000 |
| TW | 200424423 | | 11/2004 |
| TW | 200506176 | | 2/2005 |

* cited by examiner

GUIDE VANE ARRANGEMENT OF A TURBOMACHINE

This application is a continuation of International Patent Application No. PCT/EP2006/065188, filed on Aug. 9, 2006, which claims priority to Swiss Patent Application No. CH 1348/05, filed on Aug. 17, 2005. The entire disclosure of both applications is incorporated by reference herein. The International Patent Application designated the United States and was published in German as WO 2007/020217 on Feb. 22, 2007.

The present invention relates to a guide vane arrangement of a turbomachine, in particular of a gas turbine.

BACKGROUND

A typical guide vane arrangement comprises at least one guide vane carrier which is fastened to a casing of a turbomachine. Moreover, a guide vane arrangement of this type comprises a plurality of guide vanes which are fastened to the guide vane carrier and are arranged next to one another in the circumferential direction. Normally, each guide vane has a platform possessing at least two locking portions which are spaced apart from one another circumferentially. Each locking portion has a tongue which projects from the platform in a circumferential direction and which extends in the axial direction. The guide vane carrier has at least two carrying portions which are spaced apart from one another in the circumferential direction. Each carrying portion has a groove which is open in the circumferential direction and which extends in the axial direction. The tongues of the locking portions and the grooves of the carrying portions are configured such that they provide an axially pluggable and radially positive fastening between the guide vane carrier and the respective guide vane. A guide vane arrangement of this type affords the possibility of mounting and demounting individual guide vanes, without the entire guide vane carrier being dismantled.

SUMMARY OF THE INVENTION

An object of the present invention is to provide an improved guide vane arrangement which preserves the possibility of the simple mounting and demounting of individual guide vanes.

One aspect of the present invention is the idea of arranging the locking portions and the complementary carrying portions with an axial offset. The mounting and demounting of the guide vanes are simplified, since the axial movement of the guide vanes which has to be carried out so that the positive fastening can be made is reduced significantly. Problems, such as distortion, jamming and tilting along the axial contact, are reduced. Since the cooperating carrying portions and locking portions extend in the circumferential direction, the guide vane arrangement according to the invention makes it possible to adjust the guide vanes in the circumferential direction.

According to a preferred embodiment, the platform has a cavity which is delimited radially on the inside by a base and which is delimited axially and circumferentially by walls which project outward from the base. The guide vane carrier has a common collecting duct which extends in the circumferential direction. The casing has at least one cooling-gas supply duct which is connected fluidically to the common collecting duct. The guide vane carrier has a plurality of connecting orifices which in each case connect the common collecting duct fluidically to one of the cavities. By virtue of this feature, the guide vane carrier comprises an important component of a cooling-gas supply path. Said common collecting duct significantly simplifies the supply of cooling gas through the casing of the turbomachine, since the cooling-gas supply duct in the casing can be arranged in a suitable portion of the casing, and because the arrangement of the cooling-gas supply duct is independent of the arrangement of the guide vanes.

In another embodiment of the invention, the guide vane arrangement makes it possible to equip circumferentially adjacent guide vanes with a gap seal arrangement. Said gap seal arrangement is designed for sealing a gap which extends axially in each case between two circumferentially adjacent guide vanes. With the aid of a gap seal arrangement of this type, the leakage of cooling gas through said gap can be reduced significantly. A decrease in the leakage of cooling gas results in an increase in the efficiency of the turbomachine.

Other objects and many of the concomitant advantages of the present invention are perceived more easily and are better understood by reference to the following detailed description, insofar as this is taken into account in conjunction with the accompanying drawings.

BRIEF DESCRIPTION OF THE DRAWINGS

Preferred embodiments of the invention are illustrated in the drawings and are explained in more detail in the following description. Features which are essentially or functionally identical or similar are referred to by the same reference symbol or reference symbols.

DETAILED DESCRIPTION OF THE DRAWINGS

Figure 1:
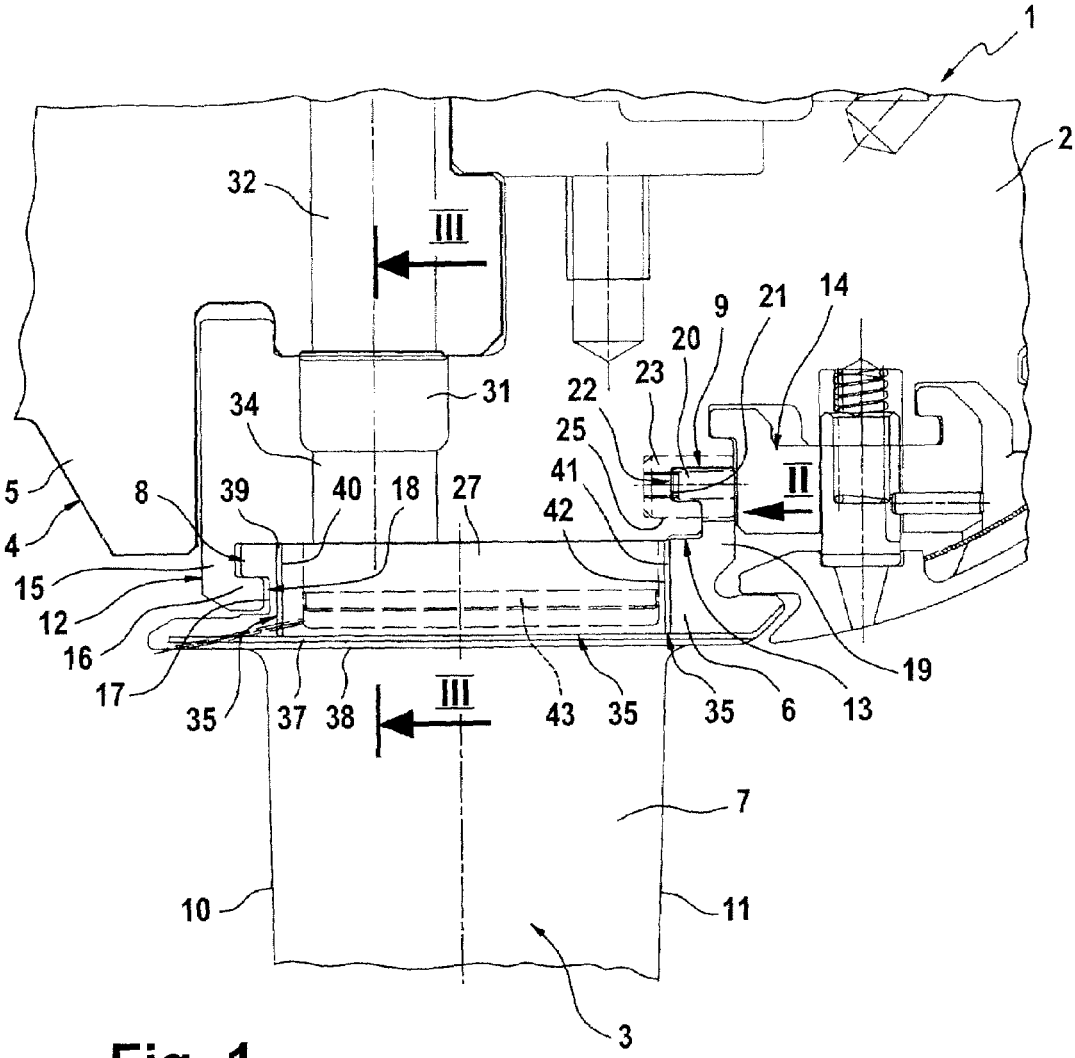
FIG. 1 shows a simplified diagrammatic axial section through a guide vane arrangement corresponding to an embodiment of the invention.

According to FIG. 1, a guide vane arrangement 1 according to an embodiment of the invention has at least one guide vane carrier 2 and a plurality of guide vanes 3. The guide vane arrangement 1 is part of a turbomachine 4. Said turbomachine 4 is, in particular, a gas turbine. In principle, the turbomachine may also be a steam turbine or a compressor. The guide vane arrangement 1 has the guide vanes 3 of a guide vane row of the turbomachine 4. Conventionally, the turbomachine 4 is equipped with a plurality of guide vane rows.

In principle, each of these guide vane rows may have the guide vane arrangement 1 according to the invention.

The guide vane carrier 2 is fastened to a casing 5 of the turbomachine 4. The guide vanes 3 are fastened to the guide vane carrier 2. In order to form the guide vane row, the guide vanes 3 are arranged next to one another in the circumferential direction.

Each guide vane 3 has a platform 6 and a flow profile 7 which projects radially and inward from the platform 6. The platform 6 has a first locking portion 8, which is illustrated on the left side of FIG. 1, and a second locking portion 9, which is illustrated on the right side of FIG. 1. The locking portions 8, 9 are arranged with a mutual axial spacing. For example, the first locking portion 8 is arranged in the region of an outflow side 10 of the profile 7, while the second locking portion 9 is arranged in the region of an inflow side 11 of the profile 7.

The guide vane carrier 2 has, complementarily to the locking portions 8, 9, a first carrying portion 12 and a second carrying portion 13. The two carrying portions 12, 13 are likewise spaced apart axially from one another. Each locking portion 8, 9 and the associated carrying portion 12, 13 are designed such that they provide an axially pluggable and a radially positive fastening between the guide vane carrier 2 and the respective guide vane 3. In other words, the cooperating locking portions 8, 9 and carrying portions 12, 13 afford an axial plugging-in or pressing movement for mounting the respective guide vane 3 and an axial unplugging or pulling movement for demounting said guide vane. In the mounted state, the cooperating locking portions 8, 9 and carrying portions 12, 13 set up a positive radial fixing between the guide vane carrier 2 and the respective guide vane 3.

In addition, the guide vane arrangement 1 has at least one securing element 14 which is fastened to the guide vane carrier 2. Said securing element 14 is designed such that it provides an axial fixing of at least one of the guide vanes 3. The guide vane 3, in its mounted state, is axially fixed or secured by means of said securing element 14.

Preferably, the carrying portions 12, 13 and the locking portions 8, 9 extend in the circumferential direction. In principle, during mounting, each guide vane 3 can be adjusted in the circumferential direction. Such adjustment may be advantageous in order to eliminate or to reduce play between adjacent guide vanes 3. According to the preferred embodiment, the first locking portion 8 and the second locking portion 9 are arranged at a mutual radial spacing. This features leads to an axially compact structure of the guide vane arrangement 1. Moreover, this feature reduces production costs. The first carrying portion 12 and the second carrying portion 13 may, of course, also be spaced apart radially from one another.

The first carrying portion 12 has an inner collar 15 which projects radially inward from the guide vane carrier 2 and which extends in the circumferential direction. Said inner collar 15 is equipped with an inner tongue 16 which extends axially and circumferentially. Complementarily to this, the first locking portion 8 has an inner groove 17. Said inner groove 17 is axially open and extends circumferentially. Said inner tongue 16 and said inner groove 17 are configured such that they provide a first tongue-and-groove connection 18 between the guide vane carrier 2 and the respective guide vane 3. In the mounted state, the inner tongue 16 projects axially into the inner groove 17 and engages radially on the platform 6.

The second locking portion 9 has an outer collar 19 which projects radially outward from the platform 6 and which extends in the circumferential direction. Said outer collar 19 is equipped with an outer tongue 20 which extends in the axial direction and in the circumferential direction. The second carrying portion 13 is correspondingly equipped with an outer groove 21 which is axially open and which extends circumferentially. Said outer tongue 20 and said outer groove 21 are configured such that they provide a second tongue-and-groove connection 22 between the guide vane carrier 2 and the respective guide vane 3. In the mounted state, the outer tongue 20 extends into the outer groove 21 and engages radially on the guide vane carrier 2.

As mentioned above, during mounting, the guide vane 3 can be adjusted in the circumferential direction. In order to fix circumferentially a set position between the guide vane carrier 2 and the respective guide vane 3, a locking pin 23 is provided. Said locking pin 23 penetrates into a depression 24 which is cut out in the outer collar 19. Said locking pin 23 is screwed into a complementary threaded orifice 25 which is provided in the guide vane carrier 2.

Figure 2:
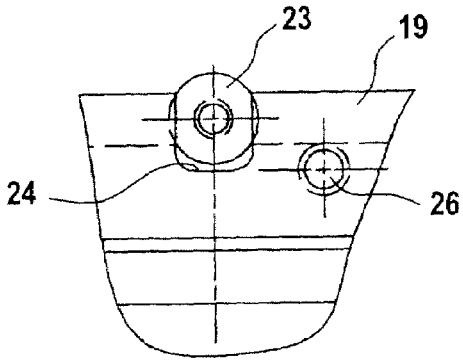
FIG. 2 shows a view of a detail according to the arrow II in FIG. 1.

According to FIG. 2, the guide vane 3 is preferably equipped with at least one pull-out orifice 26 which is a threaded orifice provided for cooperation with a pull-out device, not shown. A pull-out device of this type makes it simpler to pull or pull off the guide vane 3 from the guide vane carrier 2.

Figure 3:
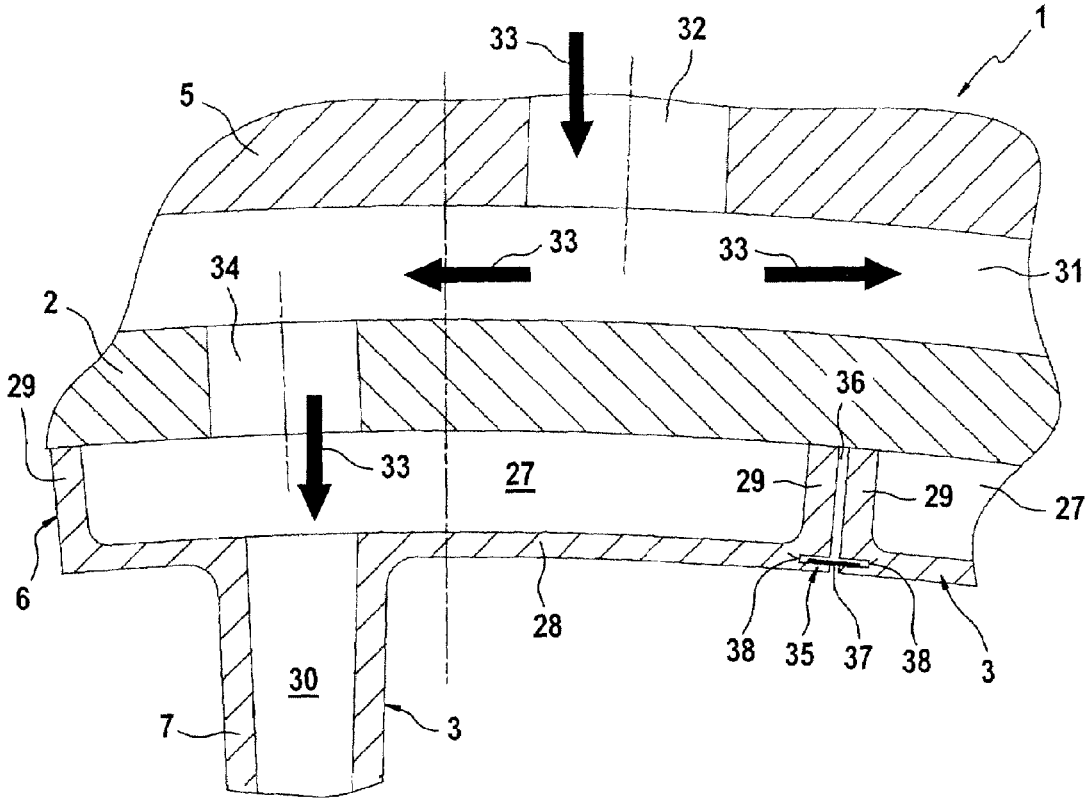
FIG. 3 shows a circumferential section corresponding to the sectional lines III in FIG. 1.

According to FIG. 3, the platform 6 has a cavity 27 which is open toward the guide vane carrier 2. Said cavity 27 is delimited radially on the inside by a base 28 of the platform 6. The flow profile 7 projects radially inward from said base 28. The cavity 27 is delimited axially and circumferentially by walls 29. Said walls 29 project radially outward from the base 28. The cavity 27 forms a cooling-gas distribution chamber. For example, the flow profile 7 contains a cooling-gas path 30 which is connected fluidically to the cavity 27 by means of the base 28.

The guide vane carrier 2 is equipped with a common collecting duct 31. Said common collecting duct 31 extends circumferentially and preferably extends along the entire guide vane carrier 2. The casing 5 is equipped with at least one cooling-gas supply duct 32 which is connected fluidically to a cooling-gas supply device, not shown. Moreover, said cooling-gas supply duct 32 is connected fluidically to the common collecting duct 31 and consequently supplies the common collecting duct 31 with cooling gas. The cooling-gas flow is symbolized by means of arrows 33. The guide vane carrier 2 is additionally equipped with a plurality of connecting orifices 34. Each connecting orifice 34 connects the common collecting duct 31 fluidically to one of the cavities 27. Correspondingly, the cavities 27 of the guide vanes 3 are supplied with cooling gas from the common collecting duct 31 via the respective connecting orifice 34. A baffle plate 43 may be arranged in the cavity 27.

The use of a common collecting duct 31 for supplying cooling gas, which is preferably air or steam, to a plurality of or all of the guide vanes 3 has the advantage that the supply of cooling gas to the respective guide vane 3 can be provided at the same pressure on account of approximately identical cooling-gas path configurations between the common collecting duct 31 and the cavities 27 of the respective guide vanes 3. In addition, the at least one cooling-gas supply duct 32 can be arranged within the casing 5 independent of the position of the respective guide vane 3. The number of cooling-gas supply ducts 32 may also be smaller than the number of guide vanes 3 to be supplied with cooling gas. Flexibility in the design of the casing 5 is increased, with the result that the production costs for the casing 5 are reduced.

One of the walls 29, which axially delimits the cavity 27 in the region of the outflow side 10 of the flow profile 7, is provided with the first locking portion 8. The other wall 29, which axially delimits the cavity 27 in the region of the inflow side 11 of the flow profile 7, is equipped with the second locking portion 9. Correspondingly, the cavity 27 extends axially from the outflow side 10 as far as the inflow side 11. Said cavity 27 extends in the circumferential direction over the entire circumferential extent of the base 28.

According to FIG. 3, circumferentially adjacent guide vanes 3 are equipped with a gap seal arrangement 35. Said gap seal arrangement 35 is designed for sealing a gap 36 which is formed in each case between two circumferentially adjacent guide vanes 3. Said gap 36 extends axially between the two adjacent guide vanes 3. In particular, the gap 36 extends between two walls 29 which circumferentially delimit the cavities 27 of said guide vanes 3.

Said gap seal arrangement 35 has a radial sealing plate 37 which extends circumferentially and axially. The radial sealing plate 37 possesses a relatively small thickness perpendicularly to its extent, since the radial sealing plate 37 is shaped as a plate. The platforms 6 of the two adjacent guide vanes 3 are provided with two radial sealing slits 38. Said pair of radial sealing slits 38 are arranged circumferentially opposite one another and extend axially and circumferentially. The radial sealing plate 37 is inserted into the radial sealing slit 38 in order to achieve a radial sealing action.

According to FIG. 1, the gap seal arrangement 35 may also have a first axial sealing plate 39 which is arranged in the region of the first locking portion 8. Said first axial sealing plate 39 extends circumferentially and radially. The first axial sealing plate 39 possesses a relatively small thickness perpendicularly to its extent. The platforms 6 of the two adjacent guide vanes 3 are provided with two circumferentially opposite first axial sealing slits 40. Said first axial sealing slits 40 extend circumferentially and radially. The first axial sealing plate 39 is inserted into said pair of first axial sealing slits 40 in order to achieve an axial sealing action.

In addition, the gap seal arrangement 35 also has a second axial sealing plate 41 which extends parallel to the first axial sealing plate 39. Said second axial sealing plate 41 is arranged in the region of the second locking portion 9. The platforms 6 of the two adjacent guide vanes 3 are likewise provided with two circumferentially opposite second axial sealing slits 42, into which the second axial sealing plate 41 is inserted in order to achieve an axial sealing action.

Figure 4:
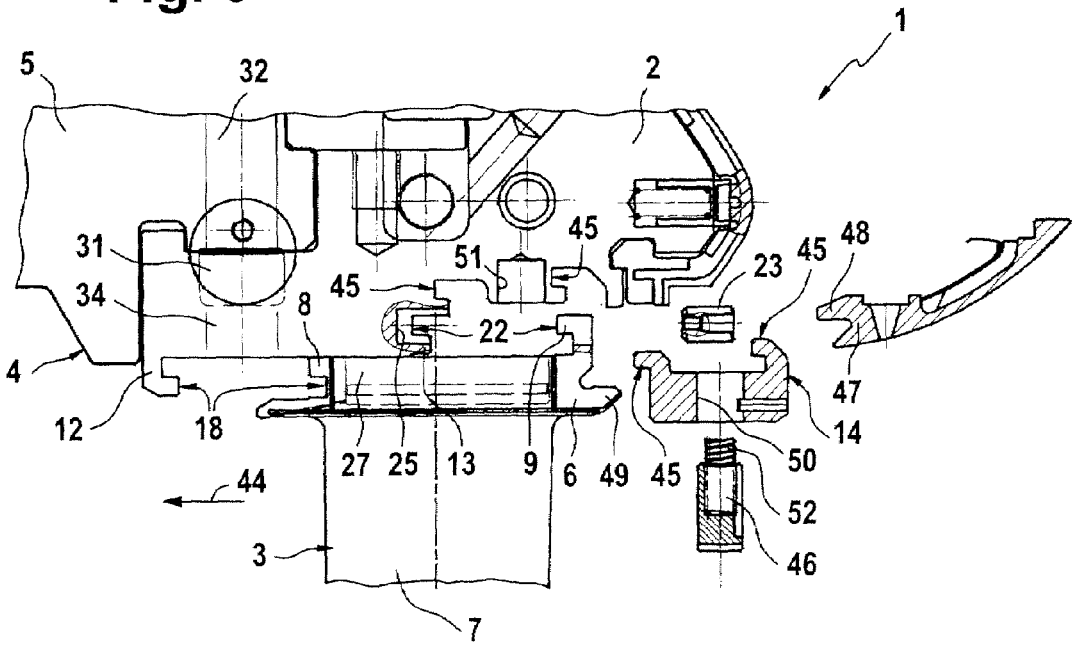
FIG. 4 shows an exploded illustration of the guide vane arrangement according to FIG. 1.

According to FIG. 4, each individual guide vane 3 can be mounted and demounted independently of other guide vanes 3. In particular, the guide vane carrier 2 does not have to be demounted in order to mount and demount the guide vanes 3.

For mounting the guide vane 3 on the guide vane carrier 2, the respective guide vane 3 is moved axially according to an arrow 44. In a final phase of this axial movement, the two tongue-and-groove connections 18, 22 are made by the tongues 16, 20 being plugged axially into the respective grooves 17, 21. After this plugging-in operation, the respective guide vane 3 is fastened radially to the guide vane carrier 2 by means of the positive connection provided by the tongue-and-groove connections 18, 22.

In order to fix the guide vane 3 circumferentially with respect to the guide vane carrier 2, the locking pin 23 is mounted. After the mounting of the locking pin 23, the securing element 14 is mounted on the guide vane carrier 2. Preferably, the securing element 14 and the guide vane carrier 2 are equipped with two tongue-and-groove connections 45 which resemble the tongue-and-groove connections 18, 22 between the guide vane 3 and the guide vane carrier 2. The securing element 14 is fastened to the guide vane carrier 2 by means of at least one locking bolt 46 in conjunction with at least one inlet segment 47. Said inlet segment 24 is equipped with an outer step 48. The platform 6 is provided with an inner step 49 which is arranged at the rear end of the platform 6 with respect to the mounting direction 44. In the mounted state according to FIG. 1, the outer step 48 of the inlet segment 47 is in engagement with the inner step 49 of the guide vane 3. The inlet segment 47 is consequently carried by the guide vane 3. The inlet segment 47 may additionally be fastened to the guide vane carrier 2 by further fastening means, not shown.

The locking bolt 46 penetrates through the securing element 14 within a through orifice 50 and projects into a blind hole 51 which is formed on the guide vane carrier 2. In the mounted state, said locking bolt 46 is carried radially on the inside by the inlet segment 47. The locking bolt 46 is carried radially on the outside by the guide vane carrier 2 by means of a compression spring 52. The locking bolt 46 secures the axial position of the securing element 14 and the support between the two steps 48 and 49.

What is claimed is:

1. A guide vane arrangement of a turbomachine, comprising:

a casing;

at least one guide vane carrier connected to the casing and having a first carrying portion and a second carrying portion spaced apart axially from the first carrying portion;

a plurality of guide vanes connected to the guide vane carrier and arranged next to each other in a circumferential direction, each guide vane having a platform including a first locking portion and a second locking portion spaced apart axially from the first locking portion, wherein each of the first and second locking portions and the respective first and second carrying portion are configured to provide an axially pluggable and a radially positive fastening between the guide vane carrier and the respective guide vane; and at least one securing element connected to the guide vane carrier and configured to provide an axial fixing of at least one of the guide vanes, wherein the at least one securing element is axially removeable so as to enable each of the plurality of guide vanes to be individually mountable and demountable.

2. The guide vane arrangement as recited in claim 1, wherein the first and second carrying portions and the first and second locking portions extend in the circumferential direction.

3. The guide vane arrangement as recited in claim 1, wherein the first locking portion and the second locking portion are disposed at a mutual radial spacing.

4. The guide vane arrangement as recited in claim 1, wherein the first carrying portion and the second carrying portion are disposed at a mutual radial spacing.

5. The guide vane arrangement as recited in claim 1, wherein the first carrying portion has an inner collar projecting radially inward and extending in the circumferential direction, the inner collar including an inner tongue extending axially and circumferentially, and wherein the first locking portion has an inner groove, the inner groove being axially open and extending circumferentially, wherein the inner tongue and inner groove are configured to provide a first tongue-and-groove connection between the guide vane carrier and the respective guide vane.

6. The guide vane arrangement as recited in claim 1, wherein the second locking portion has an outer collar projecting radially outward and extending in the circumferential direction and including an outer tongue extending axially and circumferentially, wherein the second carrying portion includes an outer groove, the outer groove being axially open and extending circumferentially, and wherein the outer tongue and outer groove are configured to provide a second tongue-and-groove connection between the guide vane carrier and the respective guide vane.

7. The guide vane arrangement as recited in claim 1, wherein at least one of the platforms includes a cavity delimited radially inward by a base and delimited axially and circumferentially by first and second walls projecting radially outward from the base, wherein the guide vane carrier has a common collecting duct extending circumferentially, wherein the casing has at least one cooling-gas supply duct connected fluidically to the common collecting duct, and wherein the guide vane carrier has at least one connecting orifice connecting the common collecting duct fluidically to the cavity.

8. The guide vane arrangement as recited in claim 7, the first locking portion is disposed on the first wall.

9. The guide vane arrangement as recited in claim 8, the second locking portion is disposed on the second wall.

10. The guide vane arrangement as recited in claim 7, wherein each platform includes a cavity, each guide vane has a flow profile projecting radially inward from the base, each flow profile containing a cooling-gas path connected fluidically to the cavity through the base.

11. The guide vane arrangement as recited in claim 1, further comprising a plurality of gap seal arrangements, each extending axially between circumferentially adjacent guide vanes and configured to seal a gap between the circumferentially adjacent guide vanes.

12. The guide vane arrangement as recited in claim 11, wherein the gap seal arrangement has a first axial sealing plate disposed in a region of the first locking portion and extending circumferentially and radially.

13. The guide vane arrangement as recited in claim 12, wherein the platforms of the two circumferentially adjacent guide vanes include two circumferentially opposite first axial sealing slits, and wherein the first axial sealing plate is disposed in the first slits.

14. The guide vane arrangement as recited in claim 12, wherein the gap seal arrangement has a second axial sealing plate disposed in a region of the second locking portion and extending circumferentially and radially.

15. The guide vane arrangement as recited in claim 14, wherein the platforms of the two circumferentially adjacent guide vanes include two circumferentially opposite second axial sealing slits, and wherein the second axial sealing plate is disposed in the second slits.

16. The guide vane arrangement as recited in claim 11, wherein the gap seal arrangement has a radial sealing plate extending circumferentially and axially.

17. The guide vane arrangement as recited in claim 11, wherein the platforms of the two circumferentially adjacent guide vanes include two circumferentially opposite radial sealing slits and wherein the radial sealing plate disposed in the radial sealing slits.

18. The guide vane arrangement as recited in claim 1, wherein the turbomachine includes a gas turbine.

19. A turbomachine comprising at least one row of guide vanes and the guide vane arrangement as recited in claim 1.

* * * * *